US006793530B2

(12) United States Patent
Walse

(10) Patent No.: US 6,793,530 B2
(45) Date of Patent: Sep. 21, 2004

(54) ELECTRONIC CONNECTOR AND METHOD OF MAKING

(76) Inventor: Alan Walse, 445 Sunset Ave., La Grange, IL (US) 60525

( * ) Notice: Subject to any disclaimer, the term of this patent is extended or adjusted under 35 U.S.C. 154(b) by 178 days.

(21) Appl. No.: 10/216,995

(22) Filed: Aug. 12, 2002

(65) Prior Publication Data

US 2004/0082220 A1 Apr. 29, 2004

(51) Int. Cl.[7] ..... H01R 13/58
(52) U.S. Cl. ..... 439/606; 29/883; 29/858
(58) Field of Search ..... 439/606; 29/856, 29/883, 858; 264/272.11, 272.15

(56) References Cited

U.S. PATENT DOCUMENTS 3,643,208 A * 2/1972 Massa, Jr. ..... 439/606
4,043,630 A * 8/1977 Suverison et al. ..... 439/606
4,772,230 A * 9/1988 Berg ..... 439/736
5,444,910 A * 8/1995 Pesson et al. ..... 29/878
5,490,789 A * 2/1996 Simons ..... 439/101
5,879,610 A * 3/1999 Beinhaur et al. ..... 264/274
5,926,952 A * 7/1999 Ito ..... 29/883
6,056,909 A * 5/2000 Wehling et al. ..... 264/272.15
6,072,312 A * 6/2000 Van Den Berg ..... 324/207.16
6,102,739 A * 8/2000 Murakami ..... 439/587

* cited by examiner

*Primary Examiner*—Ross Gushi
(74) *Attorney, Agent, or Firm*—Dennis A. Gross; The Hill Firm

(57) ABSTRACT

An electrical connector having an end face defined by a molded annulus skirt is provided with a circumferential stiffener which is molded in place at the time of molding of the skirt intermediate the inner and outer diameters of the skirt and adjacent the end face.

10 Claims, 4 Drawing Sheets

ELECTRONIC CONNECTOR AND METHOD OF MAKING

FIELD OF THE INVENTION

This invention relates to electrical connectors and more particularly a connector part having a contact carrying recessed end face characterized by a projecting skirt which extends beyond the end face and where the skirt is provided with stiffening.

BACKGROUND OF THE INVENTION

Molded electrical connectors having recessed end faces which may support either male or female contact components are known. A common purpose for the recessed end face is to allow a mating connector member to be inserted into the recess of the other connector member therefore providing environmental protection for the actual contact's connection area. In order to enhance the environmental protection, the projecting skirt is molded of a flexible rubber or plastics material and has an inner diameter closely approximating the outer diameter of the cooperating connector portion to be inserted into the recess. In some instances there may in fact be a slight interference fit relying on the resiliency of the rubber or plastic to accommodate the inserted member.

Due to the nature of the molded rubber or plastic and to the desire to maintain a snug fit, such connectors have experienced fold-over of the open end of the skirt during insertion of the cooperating connector member. This fold-over can adversely affect the performance of the connector, both by making it difficult to make a secure connection, leading to incomplete insertion and by opening leakage paths. Additionally, the skirt end becomes susceptible to damage and tearing as a result of the fold-over.

It has been known to provide a stiffener circumferentially around the OD of the skirt adjacent the skirt's open end to provide resistance to fold-over. Such stiffeners are normally formed as metal bands or the like and are normally held in place by adhesives. It has been known to provide outer diameter grooves in the skirt for receipt of the stiffener. Such adhesive attached stiffeners can, however, deteriorate, break loose, crack, and otherwise lose effectiveness. Where the electrical connectors are used in high power connections, it is strongly desired to have a circumferential stiffener which is permanently affixed to the connector skirt.

While it has been suggested to resolve these problems by molding a circumferential stiffener into the skirt at the time of formation, this solution, while enhancing the permanency of the attachment of the circumferential stiffener to the skirt, presents manufacturing difficulties. Large, high amperage plug sets are normally molded in high pressure molds which may consist of two hinged-together mold halves which, when closed, define an interior cavity space. Mold plugs, i.e. head and gripper bars, are provided to respectively close the opposite axial ends of the mold cavity and cooperate with the cavity features to define the configuration of parts of the to-be-molded plug component. For example, the skirt has its inner diameter formed by the outer diameter of an axially extending boss projecting into the mold cavity from the head bar. That boss, in turn, has bores into which the contacts are inserted to position them during molding. If the circumferential stiffener is to be molded into the skirt, it needs to be suspended in the mold at the time of closure of the mold halves. It has been suggested to suspend the stiffener by carrying the circumferential stiffener in the mold housing itself. This can be accomplished in a number of ways, such as, for example, by utilizing a T-shaped cross section stiffener with a part of the leg of the T received in a groove in the ID of the mold cavity thereby positioning the crossbar of the T interior of the space into which the skirt will be molded. While this and other approaches to positioning the circumferential stiffener in the mold cavity may be intended to properly position the stiffener in the open area of the mold cavity which will define the skirt, they make opening and closing the mold difficult. This presents another alignment problem during the movement of the mold halves from the open position to the closed position. Because these mold halves are heavy and awkward to properly position, molded in place circumferential stiffeners proposed thusfar present significant manufacturing challenges. In addition, because the connector components are retained in place during molding by a mold head bar, any positioning of a stiffener during molding by any mold part other than the head bar can result in a mispositioning of the stiffener relative to other components.

It would therefore be an advance in the art to provide a molded in-place circumferential stiffener for circumferential skirts of electrical connectors where the stiffener would not interfere with closure of the mold during manufacturing.

SUMMARY OF THE INVENTION

This invention avoids deficiencies in the prior art by having the circumferential stiffener carried in the mold cavity by the end plug or head bar. Preferably the head bar is provided with a plurality of projecting support fingers circumferentially positioned about the boss and extending coaxially with the boss from the head bar end wall. These fingers are arranged to have outer surfaces at approximately the position of the inner diameter of the cavity. Preferably the stiffener is carried on the radially inner faces of the fingers and will therefore be spaced from the inner diameter of the cavity by the thickness of the spacer-carrying portion of the fingers. This results in the stiffener being molded into the sleeve intermediate the inner and outer diameter of the sleeve, at a position spaced from the axial end of the sleeve determined by the length of the support end of the fingers. While substantially the entirety of the spacer will be imbedded within the sleeve, the presence of the spacer is detectable by the notches left in the sleeve OD by the fingers. Upon completion of the molding, the proper positioning of the stiffener can therefore be confirmed. Further, because the fingers leave notches which are open at the skirt axial end, the positioning of the stiffener can be confirmed even after the plug has been received in an attached housing. Thereafter if desired, the notches can be partially or fully filled in.

In an embodiment of the invention, at least three fingers are provided in the head bar, and the fingers individually are provided with undersurface ledges for properly positioning the stiffener.

In an embodiment of the invention the stiffener is formed as a spring thereby enhancing its ability to conform to changes within the sleeve.

In an embodiment the stiffener is formed as a wave spring.

In an embodiment the stiffener is formed as a coil.

In an embodiment the stiffener is a solid band.

Advantages, features and objects of the present invention will become apparent upon reading the following detail description, independent claims and upon reference to the accompanying drawings.

BREIF DESCRIPTION OF THE DRAWINGS

DESCRIPTION OF PREFERRED EMBODIMENT

Figure 1:
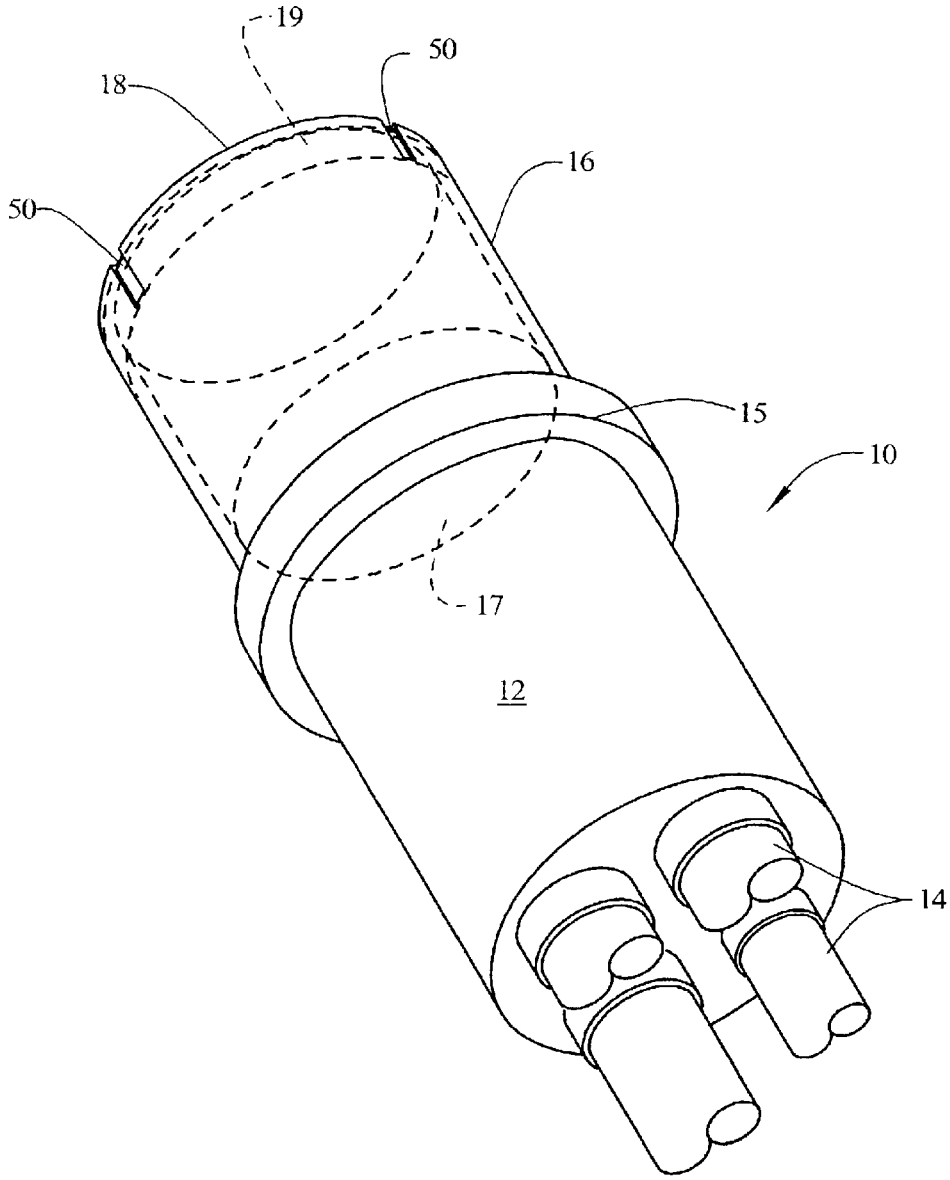
FIG. 1 is a perspective view of a connector component of this invention illustrating a recessed end face by broken lines and showing the positioning of a circumferential spacer by broken lines.

As illustrated in FIG. 1, an electrical connector component part or plug 10 consists of a connector body 12 which is molded about a plurality of wires or cables 14. The body 12 may be provided with a connector collar 15 and has a sleeve or skirt 16 which projects from an internal recessed end face 17 outwardly to a skirt end face 18. This end face defines an annular opening to the recess. A stiffener 19 is molded in place in the sleeve 16 adjacent the end face 18.

Figure 2:
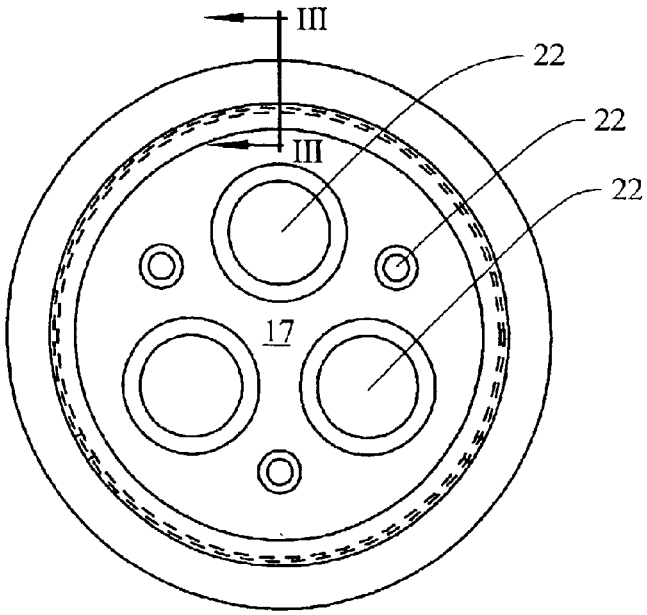
FIG. 2 is an end elevational view of the component of FIG. 1.

As shown in FIG. 2, the end face 17 will normally have a plurality of contacts 22 projecting therefrom into the interior of the recess. The contacts may be of different sizes and types, however the cables or wires 14 are affixed to the contacts for electrical connection. The contacts themselves terminate in spaced relation to the open end face 18.

Figure 3:
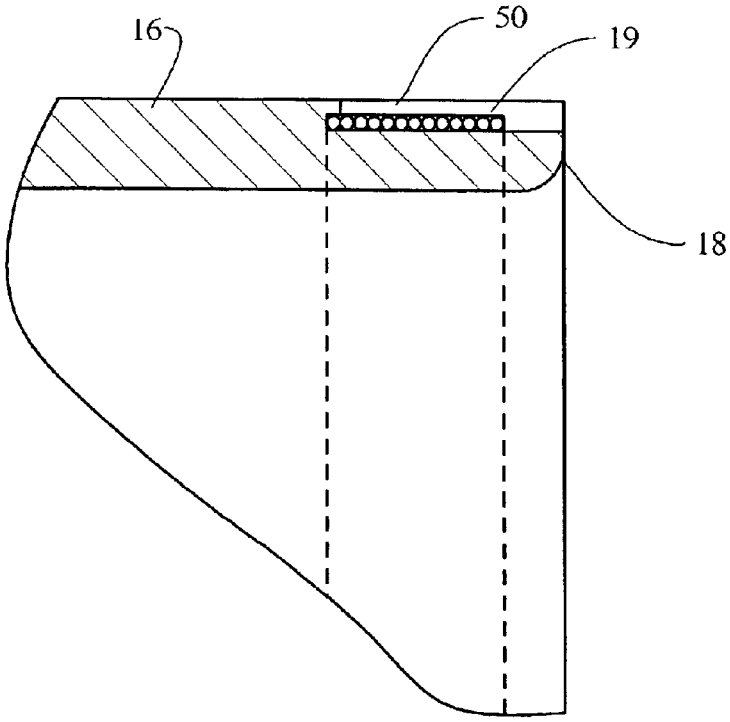
FIG. 3 is a cross sectional view of the sleeve taken along the lines III-III of FIG. 2.

As shown in FIG. 3 the skirt 16 is provided with a circumferential stiffener 19 which is molded in place in the skirt16. The stiffener may, as illustrated, be formed as a type of spring to facilitate conformity of movement between the skirt and the stiffener, or it may be formed as a solid band. The purpose of the stiffener is to prevent fold-over of the skirt during insertion of a complimentary connector member having complimentary connectors. Preferred shapes for a spring type stiffener would include an axial coil, as illustrated in FIG. 3, or a circumferential wave spring. The tightness of windings of the coil or of the pitch of the wave spring can be varied to accommodate desired stiffness and sleeve movement compatibilities.

Figure 4:
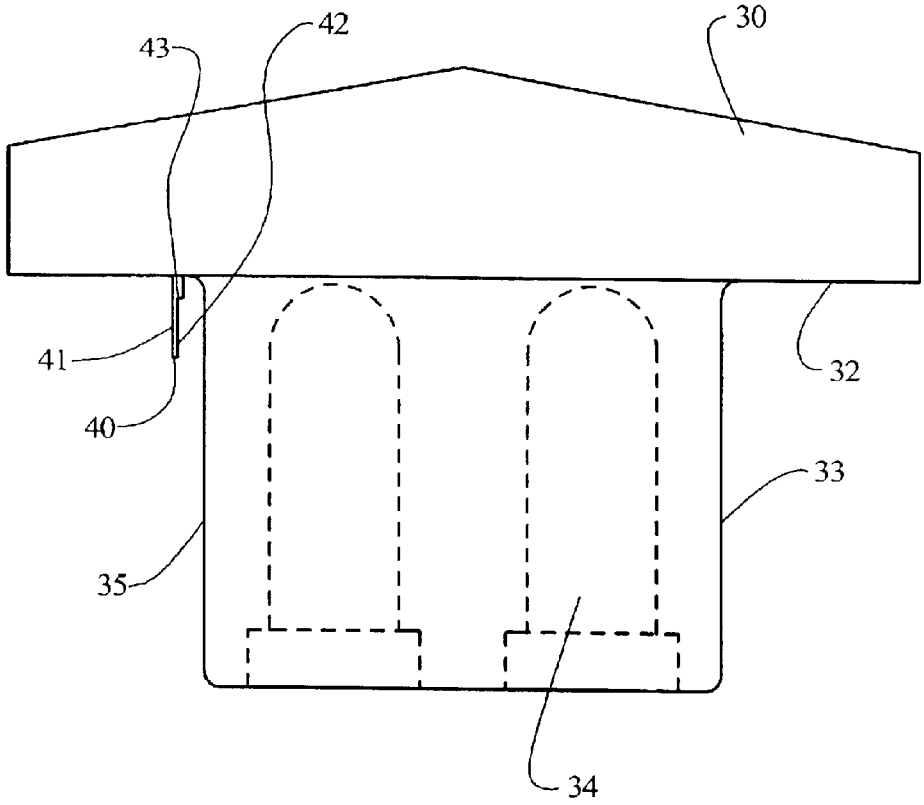
FIG. 4 illustrates a head bar having a stiffener-carrying finger.

As illustrated in FIG. 4, the head bar 30 of the mold, which is used to close one end of the mold cavity, is provided with a cavity facing end face 32 and an axially extending boss 33. The boss is provided with recesses 34 for receipt of the connectors. In the embodiment illustrated, the recesses are shown to be for male plug members, however, as will be appreciated, female socket members can equally be held in the boss recesses. Projecting from the face 32, a plurality of fingers 40 extend co-axially with the boss and are spaced from the outer diameter 35 of the boss. Preferably the outer surface 41 of the figures will lie against the inner diameter of the mold cavity when the head bar is positioned in the mold. The under face, or radially inner face 42 of the fingers, may be provided with a notch or ledge 43 against which the stiffener can abut to properly position the stiffener axially within the mold cavity. In a preferred embodiment at least three fingers are used and the stiffener rests against the surface 42 of each of the three circumferentially spaced fingers thereby holding the stiffener in place in the mold during the molding operation. As illustrated in FIG. 2, the presence of the finger in the mold, upon removal of the connector member, leaves a plurality of circumferentially spaced notches 50 through which the stiffener can be observed subsequent to molding to confirm it s correct positioning. Thereafter, if desired, the notches may be filled in or provided with a protective seal.

Figure 5:
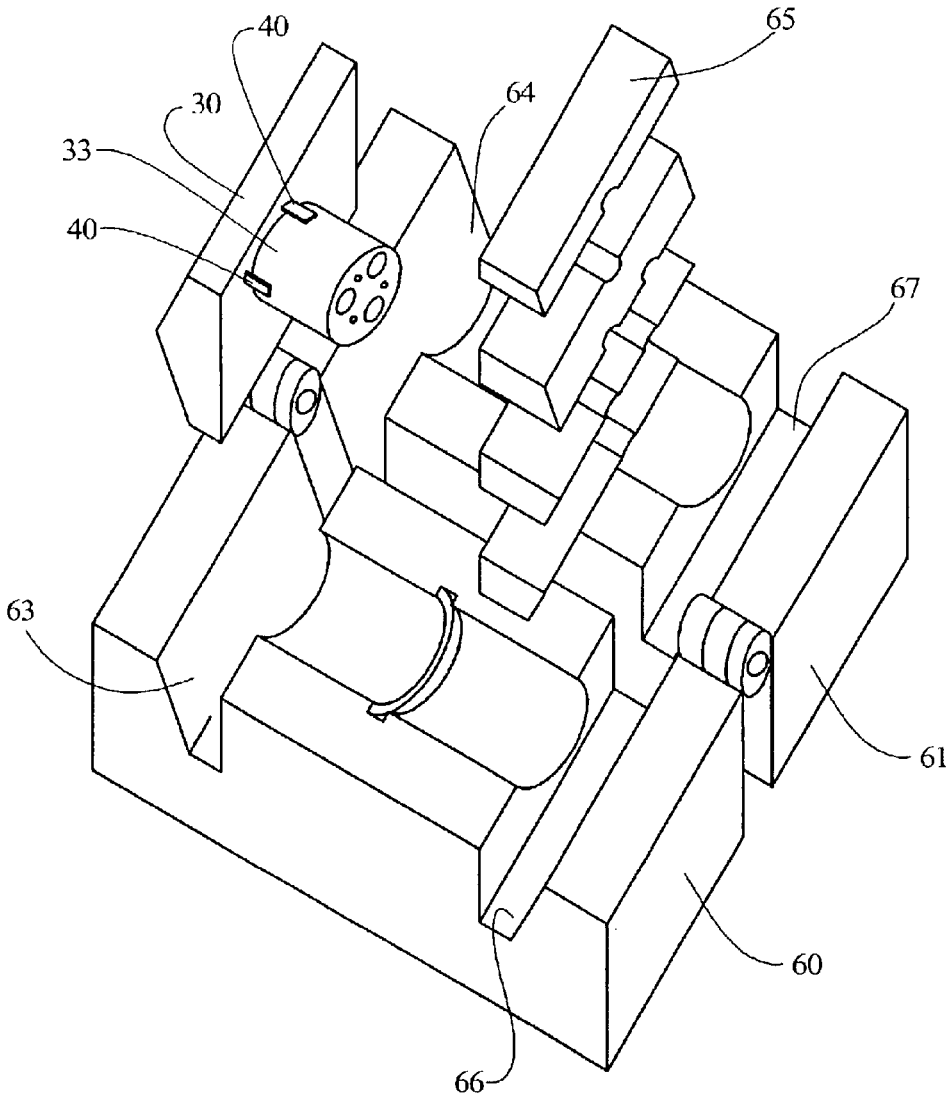
FIG. 5 is an exploded schematic view of a mold useful in this invention.

As best illustrated in FIG. 5, the mold consists of two halves, 60 and 61, which define a cavity 62. The head bar 30 is received in head bar slots 63 and 64 with the boss 33 projecting into the end of the cavity 62. At the other end of the cavity, a multi-piece gripper bar 65 is similarly received in notches 66 and 67. The number of elements of the gripper bar is determined by the number of contacts. The elements of the gripper bar maintain the proper positioning of the cables and provide for end face contouring.

An additional benefit of this invention has been observed in prototype molding tests. By torquing the coil spring, one end to the other to reduce OD dimension at the time of insertion into the fingers, insertion is simplified and upon release of the torque, the coil elastically expands to snuggly engage the ID of the fingers. Moreover during molding, heat of the molding process (which may be on the order of 350°) contracts the spring stiffener which then partially expands upon cooling, thereby providing a resultant molded product where the spring maintains elasticity both for contraction and expansion.

It would therefore be appreciated that my invention provides a method of molding in place a connector sleeve or skirt stiffener during the molding of the connector body by supporting the stiffener in the mold cavity by the head bar. By use of projecting fingers extending from the end wall of the head bar to support the stiffener during the molding operation, the stiffener can be properly positioned both axially and radially. This method also permits the use of different types of stiffeners, including solid and spring.

From the above description it will be apparent to those of ordinary skill in the art that the advantages and objects of the present invention have been achieved. While only certain embodiments have been set forth, alternative embodiments and various modifications will be apparent from the above description to those skilled in the art. For example, the stiffener could be attached to the head bar by means other than the use of fingers projecting form the head bar or the fingers could be reversed whereby the notches 50 would be at the ID of the skirt.

I claim as my invention:

1. A method of molding a circumferential stiffener into the skirt of an electrical connector body during formation of the skirt which comprises the steps of:

providing a mold cavity for molding of the connector body and skirt, Providing a head bar for closing an end of the mold cavity, providing a plurality of axially extending fingers projecting from the head bar into the cavity, supporting the stiffener on the fingers in the cavity, molding the electric connector body and skirt in the cavity while at least partially imbedding the stiffener into the skirt, and thereafter removing the molded connector body from the cavity and head bar.

2. A reinforced electrical connector comprising a connector part defining member having a molded flexible material body with an end face, an axial bore therein open to the end face defining an annular skirt extending from the end face to a bottom of the bore, a stiffener positioned within the skirt spaced from the end face, the stiffener being substantially continuously embedded within the skirt except at circumferentially spaced apart openings in the skirt open to a portion of the stiffener.

3. An electrical connector part comprising a molded body having a projecting skirt terminating in an open end, a stiffener molded into the skirt adjacent the end, the stiffener comprising a spring member.

4. The connector of claim 3 wherein the stiffener is formed as a coil.

5. The connector of claim 4 wherein the skirt open end forms an annulus and the coil is substantially circular.

6. A method of making an electrical connector part including a molded housing having an extending peripheral skirt terminating in an open end with a stiffener carried by the skirt, the improvement of forming the stiffener as a spring member and molding the stiffener into the skirt at the time of molding of the skirt.

7. A method of molding an electrical connector part having a stiffener member at least partially embedded in a skirt of the connector part which comprises the steps of providing a mold cavity, terminating an end of the mold cavity with a end closure having a central projecting boss extending into the mold cavity, the boss having an outer diameter less than an inner diameter of the mold cavity whereby a skirt will be formed between the outer diameter of the boss and the inner diameter of the mold cavity, providing a stiffener support on the end closure effective to support a stiffener in at least a part of the space between the outer and inner diameters of respectively the end closure boss and the mold cavity mounting a stiffener on the support and molding the skirt with the stiffener embedded therein.

8. The method of claim 7 including providing a plurality of said supports circumferentially spaced from one another.

9. The method of claim 8 wherein the supports position the stiffener to be substantially entirely imbedded in the skirt except for circumferentially spaced skirt discontinuities located at the position of the supports.

10. The method of claim 9 wherein the supports are provided on an inside end face of the closure member.

* * * * *